US005887242A

United States Patent [19]

Nygren et al.

[11] Patent Number: 5,887,242

[45] Date of Patent: Mar. 23, 1999

[54] METHOD OF MAKING METAL COMPOSITE MATERIALS

[75] Inventors: Mats Nygren, Bromma; Gunnar Westin, Stockholm; Åsa Ekstrand, Hässelby, all of Sweden

[73] Assignee: Sandvik AB, Sandviken, Sweden

[21] Appl. No.: 721,766

[22] Filed: Sep. 25, 1996

[51] Int. Cl.[6] ..... B22F 3/12

[52] U.S. Cl. ..... 419/35; 419/14; 419/18; 419/38; 419/57; 419/58

[58] Field of Search ..... 419/35, 38, 57, 419/58, 14, 18

[56] References Cited

U.S. PATENT DOCUMENTS 4,233,063 11/1980 Ritsko et al. .
5,505,902 4/1996 Fischer et al. .

FOREIGN PATENT DOCUMENTS 62-192501 8/1987 Japan .
63-69901 3/1988 Japan .
9526245 10/1995 WIPO .

*Primary Examiner*—Daniel J. Jenkins
*Attorney, Agent, or Firm*—Burns, Doane, Swecker & Mathis, L.L.P.

[57] ABSTRACT

A method of making a hard constituent powder coated with at least one iron group metal, Me, by dissolving and complex binding at least one of $Me_n(NO_3)_m$ and $Me_n(SO_4)_m$ and other similar $Me_n$—$X_m$ compounds containing X-groups with low or no carbon content, preferably Me-nitrates, solely or together with one or more metal salts of at least one iron group metal containing organic groups in at least one polar solvent with at least one complex former comprising functional groups in the form of OH or $NR_3$, (R=H or alkyl). Hard constituent powder is added to the solution. The solvent is evaporated and remaining powder is heat treated in an inert and/or reducing atmosphere. As a result, coated hard constituent powder is obtained which after addition of a pressing agent can be compacted and sintered according to standard practice.

15 Claims, No Drawings

METHOD OF MAKING METAL COMPOSITE MATERIALS

FIELD OF THE INVENTION

The present invention relates to a method of producing metal composite materials such as cemented carbide.

BACKGROUND OF THE INVENTION

U.S. Pat. No. 5,505,902, the disclosure of which is hereby incorporated by reference, discloses a method in which one or more metal salts of at least one iron group metal containing organic groups are dissolved and complex bound in at least one polar solvent with at least one complex former comprising functional groups in the form of OH or $NR_3$, (R=H or alkyl). Hard constituent powder and, optionally, a soluble carbon source are added to the solution. The solvent is evaporated and remaining powder is heat treated in an inert and/or reducing atmosphere. As a result, coated hard constituent powder is obtained which after addition of a pressing agent can be compacted and sintered according to standard practice to a body containing hard constituents in a binder phase.

A problem with said method is that the heat treatment of the coated powder in larger quantities (>1 kg) has to be performed in pure hydrogen and/or with unnecessary high gas flows in order to obtain the desired carbon content which for cemented carbide has to be kept in a very narrow range.

SUMMARY OF THE INVENTION

It is an object of this invention to avoid or alleviate disadvantages and/or problems of the prior art.

It is a further object of the present invention to provide an alternative to the method disclosed in U.S. Pat. No. 5,505,902 in which the hydrogen reduction is essentially eliminated.

According to the invention, a hard constituent powder coated with at least one iron group metal, Me, can be prepared in a solution formed by dissolving and complex binding at least one of $Me_n(NO_3)_m$ and $Me_n(SO_4)_m$ and other similar $Me_n$—$X_m$ compounds containing X-groups with low or no carbon content, solely or together with at least one Me-salt containing organic groups in at least one polar solvent with at least one complex former comprising functional groups in the form of OH or $NR_3$, (R=H or alkyl), the amount of Me-salts with low or no carbon content being >10% of the total amount of Me-salts; adding hard constituent powder to the solution; recovering powder by evaporating the solvent; and heat treating the powder in an inert and/or slightly reducing atmosphere to obtain said hard constituent powder coated with said at least one iron group metal.

DETAILED DESCRIPTION OF THE PREFERRED EMBODIMENTS

According to the method of the present invention, at least one organic salt of U.S. Pat. No. 5,505,902 is replaced partly or completely by a salt containing no or little carbon.

The process according to the invention comprises the following steps where Me=Co, Ni and/or Fe, preferably Co:

Step 1. At least one of $Me_n(NO_3)_m$ and $Me_n(SO_4)_m$ and other similar $Me_n$—$X_m$ compounds containing X-groups with low, <5 wt-%, preferably <2 wt-%, most preferably no carbon content, preferably Me-nitrates, are dissolved solely or together with at least one Me-salt containing organic groups such as carbooxylates, acetylacetonates, nitrogen containing organic groups such as schiff bases, preferably Me-acetates, in at least one polar solvent such as ethanol, acetonitrile, dimethlyformamide or dimethylsulfoxide and combinations of solvents such as methanol-ethanol and water-glycol, preferably methanol. The amount of Me-salts with low or no carbon content, shall be >10%, preferably >50% of the total amount of Me-salts. Triethanolamine or other complex formers especially molecules containing more than two functional groups, i. e. OH or $NR_3$ with R=H or alkyl (0.1–2.0 mole complex former/mole metal, preferably about 0.5 mole complex former/mole metal) is added under stirring.

Step 2. Hard constituent powder such as WC, (Ti,W)C, (Ta,Nb)C, (Ti,Ta,Nb)C, (Ti,W)(C,N), TiC, TaC, NbC, VC and $Cr_3C_2$, preferably well-deagglomerated, e.g., by jet milling, is added under moderate stirring and the temperature is increased to accelerate the evaporation of the solvent. When the mixture has become rather viscous, the dough-like mixture is kneaded and when almost dry, the mixture is smoothly crushed in order to facilitate the evaporation (avoiding inclusions of solvent).

Step 3. The loosened powder lump obtained in the preceding step is heat treated in an inert and/or slightly reducing atmosphere at about 400°–1100° C., preferably 500°–900° C. To achieve a fully reduced powder, a holding temperature might be needed. The time of heat treatment is influenced by process factors such as powder bed thickness, batch size, gas composition and heat treatment temperature and has to be determined by experiments. Nitrogen and/or hydrogen is normally used but argon, helium and ammonia (or mixtures thereof) can be used whereby the composition and microstructure of the coating can be modified.

Step 4. After the heat treatment the coated powder is mixed with a pressing agent in ethanol to a slurry either alone or with other coated hard constituent powders and/or uncoated hard constituent powders and/or binder phase metals and possibly carbon or tungsten to obtain the desired composition. The slurry then is dried, compacted and sintered in the usual way to obtain a sintered body of hard constituents in a binder phase. The body can comprise a tool such as a metal or rock cutting insert.

Most of the solvent can be recovered which is of great importance when scaling up to industrial production.

Alternatively, the pressing agent can be added together with the hard constituent powder according to step 2, directly dried, pressed and sintered considering the conditions according to step 3.

The invention is additionally illustrated in connection with the following Example which is to be considered as illustrative of the present invention. It should be understood, however, that the invention is not limited to the specific details of the Example.

EXAMPLE 1

A WC-6% Co cemented carbide powder mixture was made in the following way according to the invention: A mixture of 72.63 g cobalt nitratehexahydrate $Co(NO_3)_2 6H_2O$ and 62.26 g cobaltace tatetetrahydrate $Co(C_2H_3O_2)_2 4H_2O$ in the ratio nitrate/acetate 7 to 6 was dissolved in 800 ml methanol($CH_3OH$). 36.1 ml triethanolamine $N(C_2H_4OH)_3$ (0.5 mole TEA/mole Co) was added during stirring. Subsequently, 500 g jet milled WC powder was added and the temperature was increased to about 70° C. Careful stirring took place continuously during the time the methanol was evaporating until the mixture had become viscous. The dough-like mixture was worked and crushed with a light pressure when it had become almost dry.

The powder obtained was fired in a furnace in a porous bed about 1 cm thick in different batch sizes and in varying flowing gas atmosphere (gas flow: 2000 l/h), heating rate 10° C./min to 700° C., holding time: 3 h, cooling 10° C./min.

The powder batches were analyzed for cobalt and carbon contents and the results of the heat treatment program carried out are summarized below:

| Batch | Batch size | Gas Mixture | Powder Analysis, wt % | |
|---|---|---|---|---|
| No. | (kg) | ($N_2/H_2$) | Co | *C-tot |
| 1 | 0.2 | $N_2$ (100%) | 5.4 | 6.64 |
| 2 | 0.2 | $N_2$ (75%)/$H_2$ (25%) | 5.4 | 5.79 |
| 3 | 3.0 | $N_2$ (75%)/$H_2$ (25%) | 5.4 | 5.79 |

*Stoichiometric carbon content: 5.79 weight %

A reference batch was made and heat treated in an identical way except for replacement of the nitrate/acetate mixture with only 134.89 g cobaltacetatetetrahydrate $Co(C_2H_3O_2)_2$ $4H_2O$. The reference powder was analyzed for cobalt and carbon contents and the results of the heat treatment program carried out are summarized below:

| Batch | Batch size | Gas Mixture | Powder Analysis, wt % | |
|---|---|---|---|---|
| No. | (kg) | ($N_2/H_2$) | Co | *C-tot |
| 4 | 0.2 | $N_2$ (100%) | 5.4 | 7.25 |
| 5 | 0.2 | $N_2$ (75%)/$H_2$ (25%) | 5.4 | 5.79 |
| 6 | 3.0 | $N_2$ (75%)/$H_2$ (25%) | 5.4 | 6.42 |

*Stoichiometric carbon content: 5.79 weight %

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method of making a hard constituent powder coated with at least one iron group metal, Me, comprising steps of:

forming a solution by dissolving and complex binding at least one of $Me_n(NO_3)_m$ and $Me_n(SO_4)_m$ and other similar $Me_n$—$X_m$ compounds containing X-groups with low or no carbon content, solely or together with at least one Me-salt containing organic groups in at least one polar solvent with at least one complex former comprising functional groups in the form of OH or $NR_3$, (R=H or alkyl), the amount of Me-salts with low or no carbon content being >10% of the total amount of Me-salts;

adding hard constituent powder to the solution;

recovering powder by evaporating the solvent; and heat treating the powder in an inert and/or slightly reducing atmosphere to obtain said hard constituent powder coated with said at least one iron group metal.

2. The method of claim 1, wherein $Me_n$—$X_m$ comprises one or more Me-nitrates.

3. The method of claim 1, wherein the amount of Me-salts with low or no carbon content is greater than 50% of the total amount of Me-salts.

4. The method of claim 1, wherein the coated powder is formed into a mixture by mixing the coated powder with a pressing agent and the mixture is compacted and sintered to form a tool body.

5. The method of claim 1, wherein Me comprises Co, Ni and/or Fe.

6. The method of claim 1, wherein the Me-salts with low or no carbon contain less than 5 wt % C.

7. The method of claim 1, wherein Me-salts with low or no carbon contain less than 2 wt % C.

8. The method of claim 1, wherein the organic solvent comprises ethanol, acetonitrile, dimethylfonnamide, dimethylsulfoxide or combination of solvents.

9. The method of claim 1, wherein the organic solvent comprises methanol.

10. The method of claim 1, wherein the hard constituent powder comprises WC, (Ti,W)C, (Ta,Nb)C, (Ti,Ta,Nb)C, (Ti,W)(C,N), TiC, TaC, NbC, VC, $Cr_3C_2$ or combination thereof.

11. The method of claim 1, wherein the heat treatment is at a temperature of 400° to 1100° C.

12. The method of claim 1, wherein the heat treatment is at a temperature of 500° to 900° C.

13. The method of claim 1, wherein the heat treating atmosphere comprises nitrogen, hydrogen, argon, helium and ammonia or mixture thereof.

14. The method of claim 1, wherein the coated powder is formed into a mixture by mixing the coated powder with coated or uncoated hard constituent and/or binder phase metal powders and possibly carbon or tungsten and the mixture is compacted and sintered to form a densified body.

15. The method of claim 1, wherein the heat treatment is carried out for at least one hour.

* * * * *